United States Patent [19]

Tanaka et al.

[11] Patent Number: 5,016,303

[45] Date of Patent: May 21, 1991

[54] CERVICAL AND HEAD SUPPORT PILLOW

[75] Inventors: Kazuna Tanaka, Cos Cob; Jeffrey Kapec, Westport, both of Conn.; Allan Chochinov, Brooklyn, N.Y.

[73] Assignee: Lumex, Inc., Bay Shore, N.Y.

[21] Appl. No.: 364,023

[22] Filed: Jun. 9, 1989

[51] Int. Cl.[5] ..... A47C 20/02

[52] U.S. Cl. ..... 5/437; 5/434

[58] Field of Search ..... 5/431, 432, 434, 435, 5/436, 437, 446, 447, 464, 465

[56] References Cited

U.S. PATENT DOCUMENTS

| | | | |
|---|---|---|---|
| 2,167,622 | 8/1939 | Bentivoglio | 5/434 X |
| 3,148,389 | 9/1964 | Lustic | 5/434 X |
| 3,222,694 | 12/1965 | Schick | 5/431 |
| 3,243,828 | 4/1966 | McCarty | 5/437 |
| 3,319,272 | 5/1967 | Eller | 5/436 |
| 3,521,310 | 7/1970 | Greenawalt | 5/436 |
| 4,432,107 | 2/1984 | Clark et al. | 5/434 X |
| 4,494,261 | 1/1985 | Morrow | 5/434 X |
| 4,536,905 | 8/1985 | DeSantis | 5/434 |
| 4,675,930 | 6/1987 | Sargent . | |
| 4,754,511 | 7/1988 | Sargent . | |
| 4,829,614 | 5/1989 | Harper | 5/436 |
| 4,850,068 | 7/1989 | Walpin et al. | 5/436 X |

FOREIGN PATENT DOCUMENTS

| | | | |
|---|---|---|---|
| 1238992 | 7/1988 | Canada | 5/434 |
| 101524 | 11/1981 | Fed. Rep. of Germany | 5/434 |
| 2305956 | 12/1976 | France | 5/434 |
| 2504795 | 11/1982 | France | 5/434 |

OTHER PUBLICATIONS

Jackson Cervical Pillow, undated publication possibly entitled "Med" or Orthopedic Equipment.

Western Style Wooden Pillow, undated and unidentified.

Cervical Comfort Pillow, appears to be advertisement in undated and unidentified publication.

Nite Collar, advertisement in "Physical Therapy", undated.

WAL-PIL-O, appears to be advertisement in undated and unidentified publication.

The Neck-Hugger appears in an undated promotional brochure of Contour Comfort Co.

Medmatt Cervical Pillow, appears in an advertisement in undated and unidentified publication.

OR-1041 Butterfly Pillow, undated publication possibly entited "med" or Orthopedic Equipment.

OR-1139 Crescent Cervical Pillow, undated publication possibly entitled "med"0 or Orthopedic Equipment.

The Graduate Cervical Support by Lossing Orthopedic appears in an undated and unidentified publication.

Hollow Core Pillow appears in "Medfoam" advertisement copyright 1987 by G. C. Hudson Ind. Inc.

(List continued on next page.)

*Primary Examiner*—Gary L. Smith

*Assistant Examiner*—Michael J. Milano

*Attorney, Agent, or Firm*—Davis Hoxie Faithfull & Hapgood

[57] ABSTRACT

A cervical and head support pillow having an outer pillow covering with a top half and a bottom half. Inserted in the top half is a contoured foam core which provides cervical and head support to a user when the user is in a supine or a side-lying position. Two cervical rolls of different convexities are in the foam core and provide varying cervical support. The pillow also has foam inserts for insertion in the bottom half of the outer pillow covering. The inserts adjust the height of the pillow and also offer the user the feeling of less or more support for the head. One of the inserts has a v-shaped depression. The user aligns the "v" in the depression with the desired cervical roll for maximum comfort. After the user inserts the desired insert pieces, the top half of the outer covering is folded over the bottom half of the covering and the pillow is closed by means of a zipper.

15 Claims, 5 Drawing Sheets

OTHER PUBLICATIONS

Ulti-Mat Pillow appears in "Medfoam" advertisement copyright 1987 by G. C. Hudson Ind. Inc.

Propillow, advertisement by Pro-Tech Pacific in undated and unidentified publication.

The Orthopedic Pillow appears in the Spring/Summer Supplement of 1987 to an unidentified publication.

Ultra Sleep System Pillow appears in an advertisement in an undated and unidentified publication.

Slumbar Roll appears in an undated and unidentified chart.

The Thera-P-Support Cradle Pillow appears in an undated marketing brochure of Thera-P-Cushion Inc., Canada/U.S.A.

Shape-It-Yourself Pillows by Comfortably Yours, advertisement in undated and unidentified publication.

Adjust-A-Curve Orthopedic Pillow appears in an advertisement in an undated and unidentified publication.

Today's Pillow is an advertisement copyrighted 1987 by The Pillow Co. and appearing in "The American Chiropractor", 2/88.

Therapeutic Pillow, U.S. Pat. No. 3,829,917 appears in what looks like a promotional brochure, undated.

Snore-Reducing Pillow appears to be an advertisement in the mid-Summer Supplement 1989 of an unidentified publication.

Posture Royal in an advertisement in "Physical Therapy", undated.

Opti-Curve Therapeutic Pillow by AnaMed Healthcare, appears in undated promotional material.

SleepSaver Orthopedic Pillow, undated and unidentified promotional brochure.

Support II Pillow by Lossing Orthopedic, undated and unidentified promotional brochure.

Peach Pillow by McCarty's appears in advertisement in unidentified and undated publication or in marketing brochure.

Wal-Pil-O LuvsYa Family by Postural Advantage appears to be an undated promotional brochure.

Spine-X Orthopedic Pillow appears in an undated, unidentified publication.

The Ortho-Pillow by Isomax, Inc., appears to be an undated marketing brochure.

"Shape of Sleep" Pillow, undated and unidentified.

"Triangular Pillow", undated and unidentified.

CERVICAL AND HEAD SUPPORT PILLOW

FIELD OF THE INVENTION

The present invention relates to a cervical and head support pillow offering varying amounts of cervical support to a user and having various inserts designed to maximize comfort and support for the user while the user is in the supine or side-lying position.

BACKGROUND OF THE INVENTION

Millions of people today suffer from back ailments due to injury, genetics or age. It is estimated that over 10 million people in the United States suffered debilitating back pain in 1988.

Back-pain sufferers can choose from a wide variety of products designed to alleviate the pain and discomfort associated with back pain. One category of such products relates to pillows for easing neck and back strain while a person is sleeping or resting on his back (the so-called supine position) or on his side. These pillow products come in various configurations and use a wide variety of padding and contouring materials, such as foam, polyester filaments, goose down, and the like, in order to provide relief to the user.

Many of these pillow products, which can be referred to as cervical and head support pillows, are designed to offer support of the cervical or neck area of the user, and also provide a comfortable area on which the user may rest his head.

There remains a need for a cervical and head support pillow which 1) offers varying amounts of cervical support for a user regardless of whether the user is in the supine position or whether the user is side-lying on the pillow; 2) maintains horizontal alignment of the spine and head when the user is side-lying; 3) maintains cervical concavity when the user is in the supine position; 4) allows for variation of the height of the pillow, depending upon individual anatomy and the comfort preference of the user; and 5) provides varying amounts of head support in both the side-lying and supine positions, depending upon the comfort requirements of the user.

SUMMARY OF THE INVENTION

The present invention is for a cervical and head support pillow having an outer covering with a top half and a bottom half. On a first side of the top half is a first receiving pocket in which a contoured foam core is located. The contoured foam core comprises foam side portions secured to a foam base. Intermediate the side portions is a first depression. Two cervical rolls, secured to opposite edges of the foam base intermediate the side portions, further define the first depression. The cervical rolls have different convexities and one cervical roll is made of a harder foam than the other.

On a second side of the top half of the outer pillow covering is quilted. Within the quilted area is a polyester filament material.

A first side of the bottom half of the outer pillow covering has two further pockets for receipt of one or more of three available foam inserts. Two of the inserts are rectangular in configuration but differ in thickness, thereby allowing the user to adjust the height of the pillow to a desired comfort level. The third insert has a v-shaped second depression. The v-shaped insert may be inserted into the pockets on the first side of the bottom half of the outer covering in one of two orientations. The first orientation of the v-shaped insert allows the user to combine the wider portion of the "v" with a particular one of the cervical rolls. The second orientation of the v-shaped insert allows the user to combine the narrow portion of the "v" with a particular one of the cervical rolls. The user chooses the proper orientation based on height, comfort and the support qualities required.

A zipper is provided as securing means for securing the top half of the outer pillow cover to the bottom half of the outer pillow cover.

DETAILED DESCRIPTION OF THE INVENTION

Figure 6:
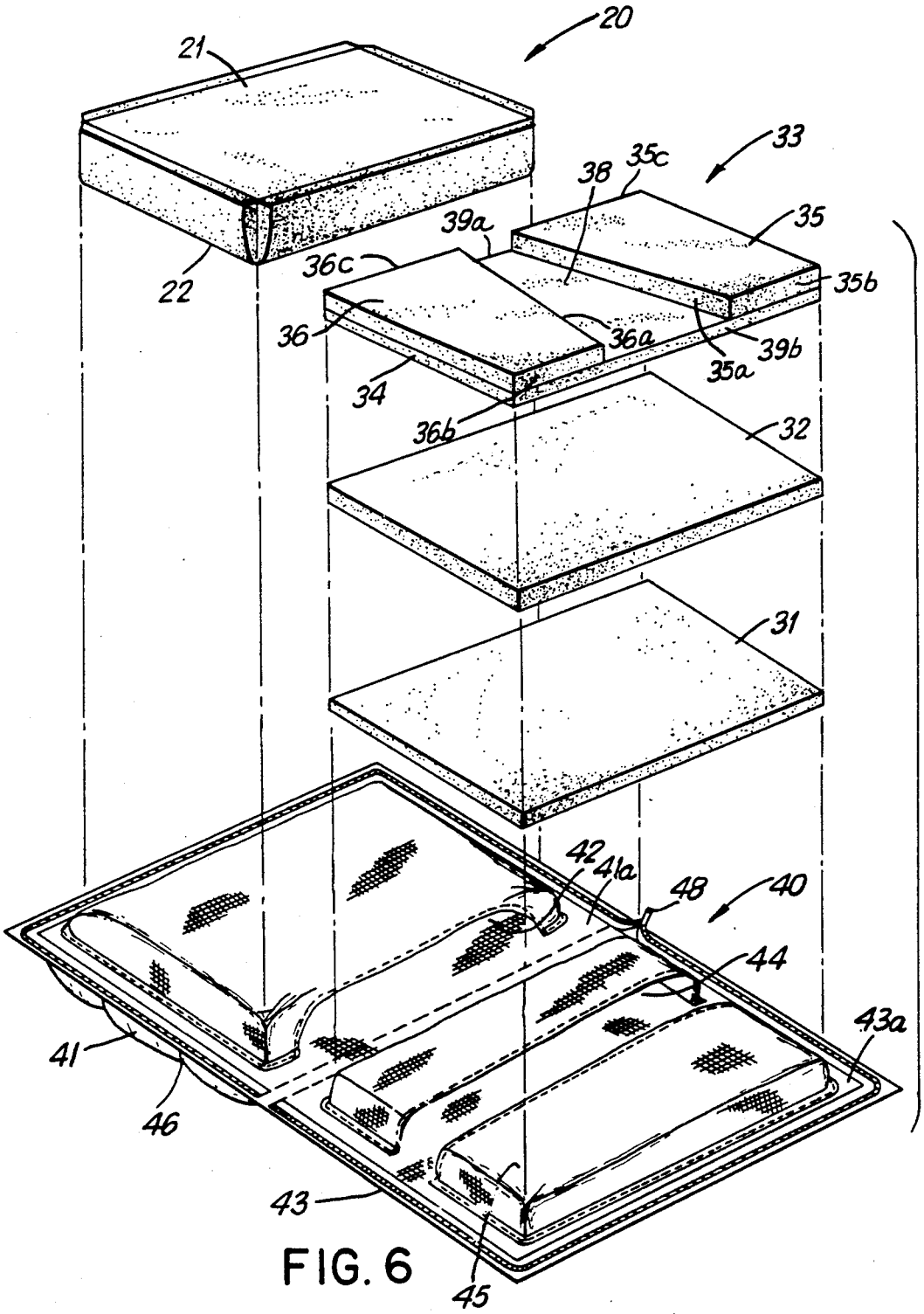
FIG. 6 is an exploded view of the pillow of FIG. 1 showing an outer pillow covering opened up into a top half and a bottom half, and also showing the fully assembled foam core, a v-shaped foam insert, a first height insert and a second height insert.

Referencing the various figures, particularly FIG. 6, it is seen that the preferred embodiment of the pillow 10 of the present invention has three basic component sections: an outer pillow covering 40 with a top half 41 and a bottom half 43; a contoured foam core 20; and three foam inserts, namely a first height insert 31, a second height insert 32 and a v-shaped insert 33.

Figure 3:
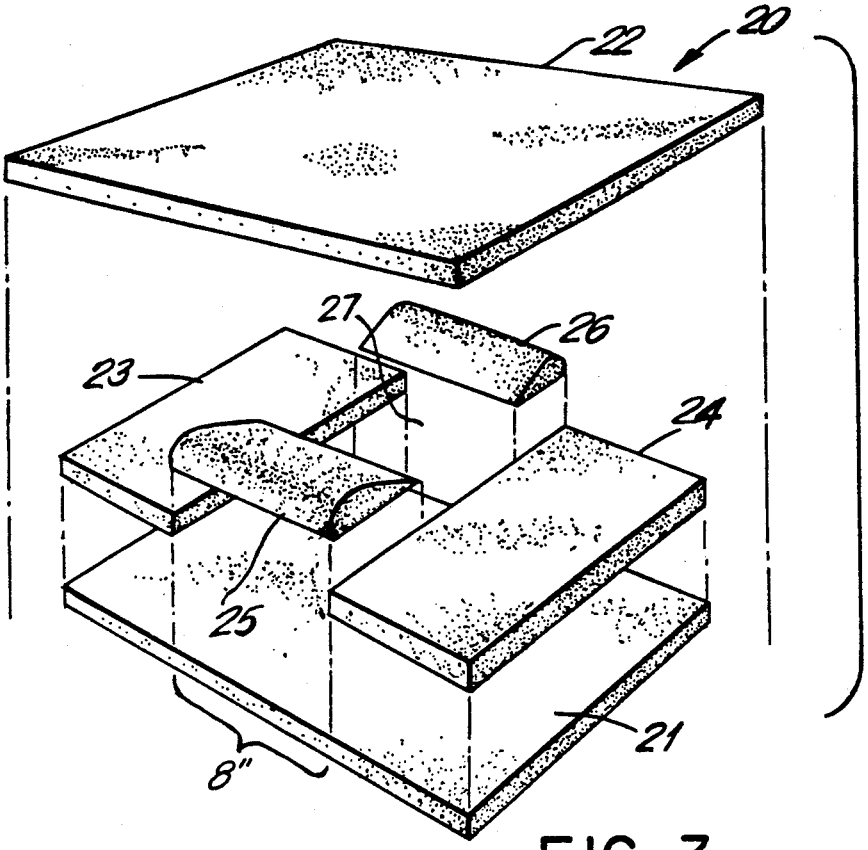
FIG. 3 is an exploded view of a foam core of the preferred embodiment of the cervical pillow of the present invention.

The contoured foam core 20 in the preferred embodiment comprises a base foam portion 21, a top foam portion 22, side foam portions 23 and 24, a first cervical support means (major cervical roll 25) and a second cervical support means (minor cervical roll 26), as best seen in FIG. 3. Foam portions 21, 22, 23 and 24 are made of a thick sheet soft foam. As referenced herein, a "soft" foam has an I.F.D. (Indentation Force Deflection) rating at 25% deflection of between 8–12 pounds per square inch and a density of one pound per cubic inch. A "medium" foam as referenced herein has an I.F.D. rating at 25% deflection of 28–34 pounds per square inch and a density of one pound per cubic inch, and a "hard" foam an I.F.D. rating of 63–77 pounds per square inch and a density of 2½–3½ pounds per cubic inch. In the preferred embodiment the base foam portion 21 has dimensions of 14"×21"×0.5", the side foam portions 23 and 24 each have dimensions of 14"×6.5"×1" and the top foam portion has dimensions of 17"×24"×0.5".

As seen in FIG. 6, the larger dimensions of the top foam portion 22 in relation to the base foam portion 21 allows the assembled foam core 20 to have folded-over edges.

Figure 4:
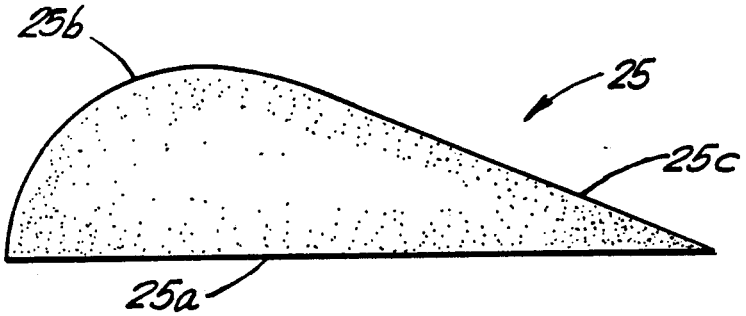
FIG. 4 is a side elevational view in isolation of a major cervical roll of the foam core shown in FIG. 3.

Major cervical roll 25, shown in more detail in FIG. 4, is made of a medium foam in the preferred embodiment. Minor cervical roll 26, shown in more detail in FIG. 5, is made of a hard foam in the preferred embodiment.

As best seen in FIG. 4, the exterior edge of major cervical roll 25 in elevation is defined by three portions, namely a flat bottom portion 25*a*, an arcuate top portion 25*b* and a ramp portion 25*c*. The arcuate top portion 25*b* is also referred to herein as a first convex portion of the major cervical roll 25. Similarly, referencing FIG. 5, the exterior edge of minor cervical roll 26 is defined by a flat bottom portion 26*a*, an arcuate portion 26*b* and a ramp portion 26*c*. The arcuate top portion 26*b* is also referred to herein as a second convex portion of the minor cervical roll 26.

Figure 5:
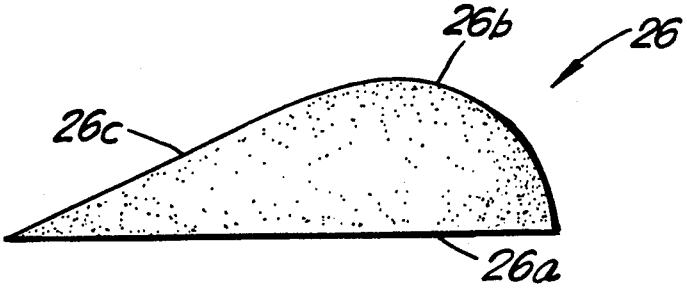
FIG. 5 is a side elevational view in isolation of a minor cervical roll of the foam core shown in FIG. 3.

The arcuate portion 26*b* is of a smaller radius than the arcuate portion 25*b*, as seen in FIGS. 4 and 5. In the preferred embodiment, the bottom portion 25*a* has a length of 4.5", and the radius of arcuate portion 25*b* is 1.25". In the preferred embodiment, the bottom portion 26*a* has a length of 3.5", and the radius of arcuate portion 26*b* is 1.0".

Cervical rolls 25 and 26 are 8" in length in the preferred embodiment so as to fit between side pieces 23 and 24 on base portion 21 when the foam core 20 is assembled, as seen in FIG. 3 and described below.

Side foam portions 23 and 24 are identical to one another. In the preferred embodiment portions 23 and 24 are rectangular and are a soft foam. When secured to the base foam portion 21, the side foam portions 23 and 24 do not extend over the entire surface of base portion 21, thereby allowing for rolls 25 and 26 to be secured to base portion 21 intermediate side portions 23 and 24.

The contoured foam core 20 is assembled as follows. First, side foam portions are secured by adhesive means such as glue to the base foam portion 21. Rolls 25 and 26 are then secured by glue or the like to base portion 21 intermediate side portions 23 and 24, as seen in FIG. 3. Finally, top foam portion 22 is secured by adhesive or the like over the side portions 23 and 24 and the rolls 25 and 26, as seen in the exploded view of FIG. 3. The edges of top foam portion 22 are folded over and secured to base foam portion 21.

The contoured foam core need not be constructed of six pieces 21, 22, 23, 24, 25 and 26 as shown in the preferred embodiment so long as the desired contouring is achieved and the cervical rolls 25 and 26 provide the necessary cervical support, as described below.

The assembled contoured foam core 20 is then inserted in a first receiving means 42 located on a first side 41*a* in the top half 41 of the outer pillow covering 40, as seen in FIG. 6. In the preferred embodiment the outer pillow covering 40 is made of a cotton-polyester fabric blend. The first receiving means 42 is in the configuration of a sewn pocket, closed on three sides, which is slightly larger than the outer dimensions of the contoured foam core 20. Any receiving means on or in the top half 41 of the outer covering 40 suitable for retaining the contoured foam piece 20 may be used.

Pocket 42 has dimensions slightly greater than the core 20. By having pocket 42 open at one side, core 20 may be removed if necessary.

Figure 1:
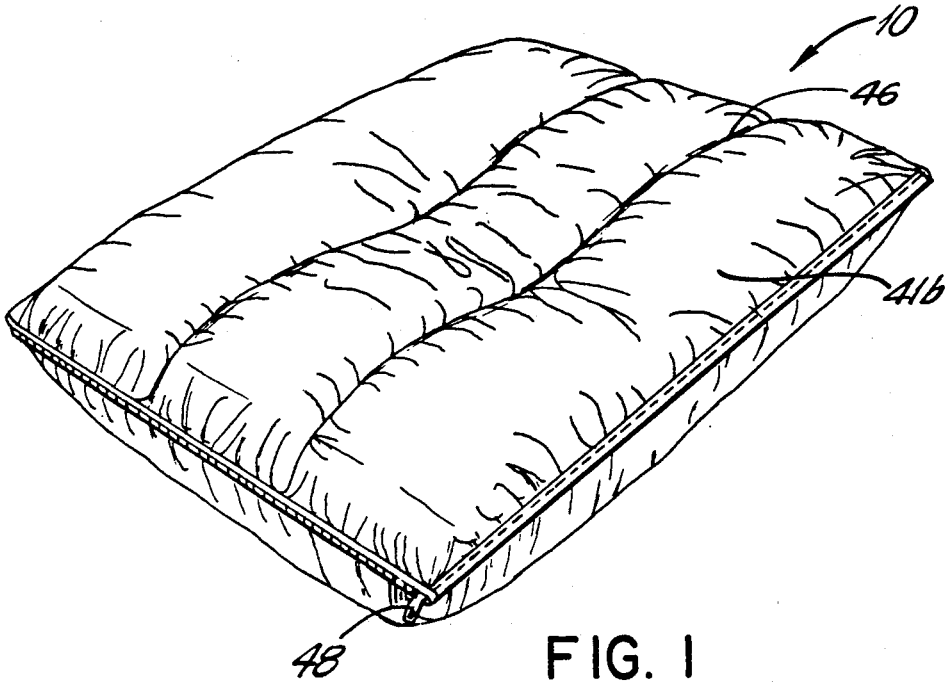
FIG. 1 is a perspective view of a cervical and head support pillow of the present invention.
Figure 9:
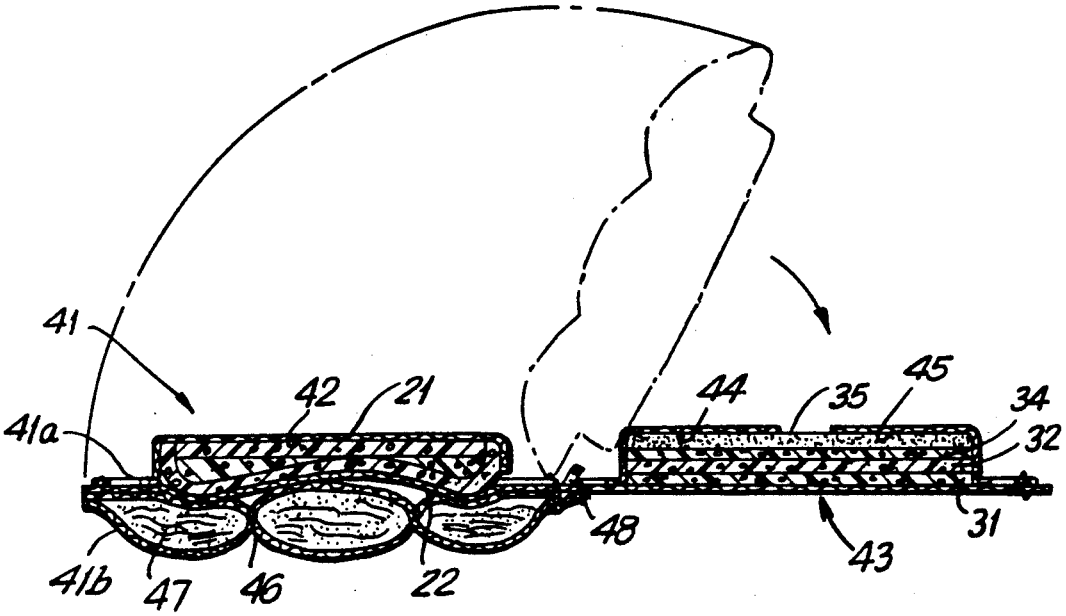
FIG. 9 is an elevated section view of the pillow of FIG. 7 along lines 9—9 of FIG. 7.
Figure 10:
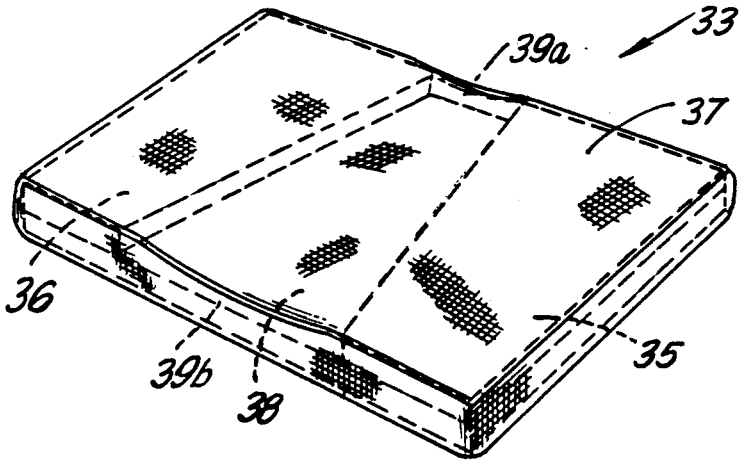
FIG. 10 is a perspective view in isolation showing the v-shaped insert of FIG. 7 with a form-fitted cloth cover.

Referencing FIGS. 1 and 9, on a second side 41*b* of the top half 41 of the outer covering 40 are a plurality of second receiving means defined by quilting 46. Located within each of the second receiving means in the preferred embodiment is a polyester filament material 47 sold by DuPont Corp. under the trademark QUALLOFIL. Any suitable filament-type padding material, such as goose-down feathers or other polyester filament materials, may be used to give the pillow 10 a "soft" feel for the user. Filament material 47 is important in the pillow 10 in order to moderate the transition felt by the user from the various parts of the contoured foam piece 20 and the varying height of the v-shaped insert 33.

Figure 7:
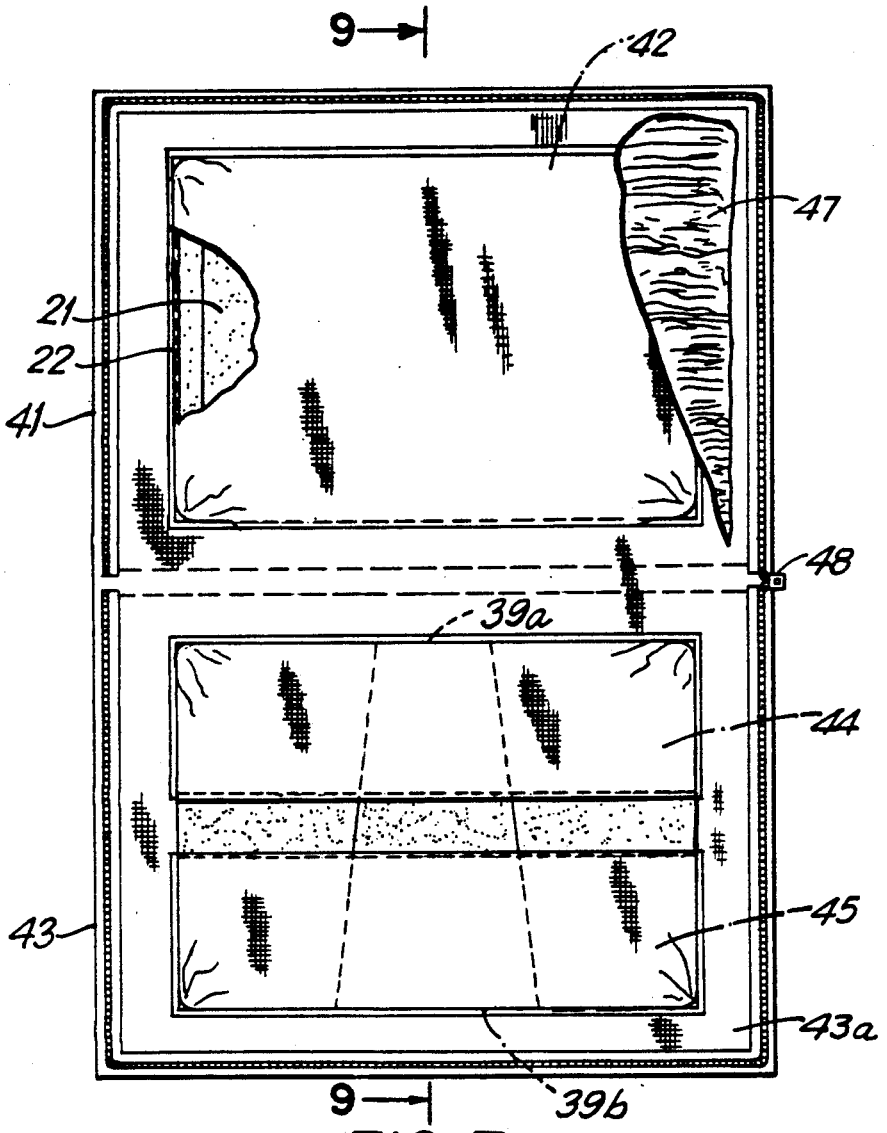
FIG. 7 is a top plan view, partly in section, of the pillow of FIG. 6 assembled.
Figure 8:
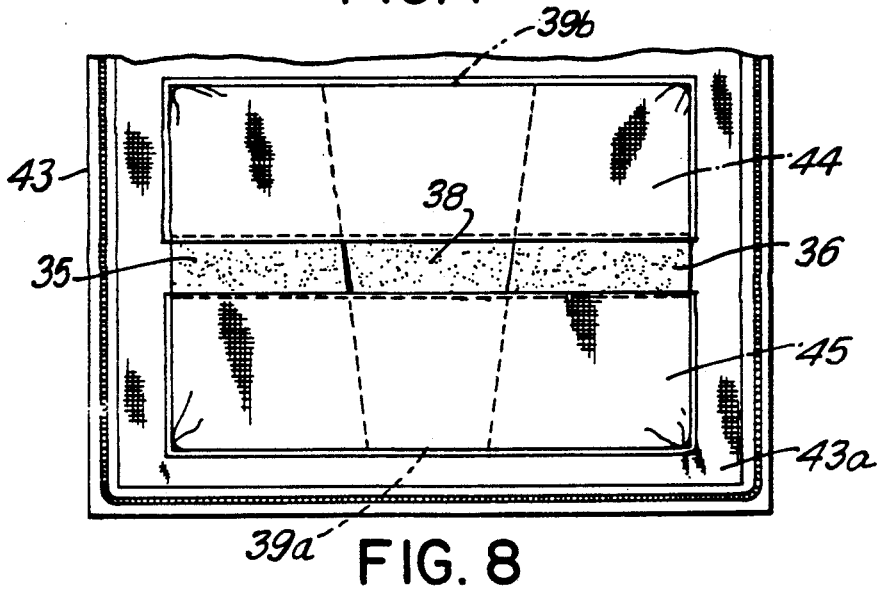
FIG. 8 is a partial top plan view as in FIG. 7 with the v-shaped insert turned 180 degrees from the position shown in FIG. 7.

A first side 43*a* of the bottom half 43 of the outer cover 40 has third receiving means for receipt of one or more of the inserts 31, 32 or 33. In the preferred embodiment the third receiving means comprises a second receiving pocket 44 and a third receiving pocket 45, as best seen in FIGS. 6, 7 and 8. Pockets 44 and 45 are sewn in the first side 43*a* of the bottom half 43 of the outer cover 40, with one side on each pocket open to receive one or more of the inserts. The pockets 44 and 45 are spaced from one another to make it easier for the user to insert and take out the inserts 31, 32 and 33. Also, the space between pockets 44 and 45 allows for visual inspection by the user of the orientation of the v-shaped insert 33. As explained below, the insert 33 may be inserted into pockets 44 and 45 in one of two primary orientations, depending upon the comfort needs of the user.

The three foam inserts, namely the first height insert 31, the second height insert 32 and the v-shaped insert 33, are best seen in FIG. 6.

V-shaped insert 33 consists of a rectangular base portion 34 and two wedged-shaped side pieces 35 and 36. Side pieces 35 and 36 are secured to base portion 34 such that a v-shaped second depression 38 is created intermediate pieces 35 and 36, as seen in FIG. 6. Second depression 38 is not an exact v-shape, as the base 39*a* of depression 38 does not terminate at a point but rather terminates at a short line. However, the angled edges 35*a* and 36*a* of side pieces 35 and 36 do converge toward one another toward the base 39*a* of a "v", as seen in FIG. 6.

In the preferred embodiment, the base portion 34 is made of thich sheet medium foam and has dimensions of 16"×23"×0.5". The side pieces 35 and 36 are also thick sheet medium foam in the preferred embodiment, each having a width dimension varying between 7" at a narrow end 35*b*, 36*b* and 8.75" at a wider end 35*c*, 36*c*, and a length of 16". The side pieces 35 and 36 are approximately 0.75" thick in the preferred embodiment. It has been determined that the side pieces 35 and 36 may also be made of soft foam.

As with foam core 20, v-shaped insert 33 may be constructed in any appropriate fashion of any number of component parts, so long as it has the second depression 38 with the desired approximate "v" shape.

In the preferred embodiment, glue is used to assemble the foam core 20 and the v-shaped insert 33, though any suitable securing means may be used.

V-shaped insert 33 has a form-fitting cotton-polyester cloth cover 37 fitted over its assembled parts. Cover 37 aids the user in inserting insert 33 easily and quickly into pockets 44 and 45, as the cloth in cover 37 minimizes the friction between the foam of insert 33 and the cloth of outer pillow covering 40. The discontinuous shape of insert 33 makes it somewhat difficult to insert it into pockets 44 and 45. Cover 37 eases the insertion of insert 33. However, cover 37 is not required on insert 33. It is anticipated that contoured foam core 20 will not be taken out of pocket 42 very often, and therefore a cover such as cover 37 is not needed for core 20, though such a cover may of course be used.

Height inserts 31 and 32 are both rectangular and are identical to one another, except that insert 32 is of a greater height than insert 31. Inserts 31 and 32 are each made of thick sheet soft foam in the present embodiment and have dimensions of 16"×23"×0.5" and 16"×23"×0.75", respectively., When inserted into pockets 44 and 45, V-shaped insert 33 usually will be on top, as shown in FIG. 6. v-shaped insert 33 may be inserted into pockets 44 and 45 in the manner shown in FIGS. 6 and 7, or may be turned 180 degrees and inserted into pockets 44 and 45 in the manner shown in FIG. 8. Insert 33 may also be turned over and inserted into pockets 44 and 45 upside down.

Inserts 31, 32 and 33 may be inserted into pockets 44 and 45 in various permutations and combinations, in groups of 1, 2 or all 3 together. The primary intended use of the v-shaped insert 33 is to place it on top of any other inserts with the depression 38 facing "up" as shown in FIG. 6. V-shaped insert may also be used in a face-down mode, though the face-up mode is preferred.

The entire pillow 10 is closed up in the manner shown in dotted line in FIG. 9, wherein the top half 41 of outer pillow covering 40 is folded over the bottom half 43 of covering 40 and the two sides secured to one another. In the preferred embodiment a nylon zipper 48 around the entire perimeter of covering 40 is used to close up the pillow 10. Any suitable securing or closing means other than zipper 48, for example "hook and loop" cloth fasteners such as those sold under the VELCRO trademark, may be used to close up the pillow 10 and secure top half 41 to bottom half 43.

When closed, pillow 10 has standard length and width pillow dimensions, such as 21"×29". This allows pillow 10 to be used with standard pillow cases if desired.

Manner of Use

The importance and value of the claimed structure of the pillow of the present invention is best understood through a description of exemplary uses of the pillow 10 and the various component parts thereof.

The user first opens up the pillow 10 by unzipping the zipper 48 and opening up top half 41 and bottom half 43 to the open position shown in FIG. 6. In the preferred embodiment, foam core 20 remains in first receiving pocket 42, unless it is necessary to clean the pillow 10, replace the core 20, etc.

The pillow 10 may be used without any of the inserts 31, 32 and 33. To use the pillow 10 in this manner, the user removes all inserts from pockets 44 and 45, closes the pillow 10 by folding the top half 41 over the bottom half 43 and zipping up the zipper 48 around the edges of top half 41 and bottom half 43.

Figure 2:
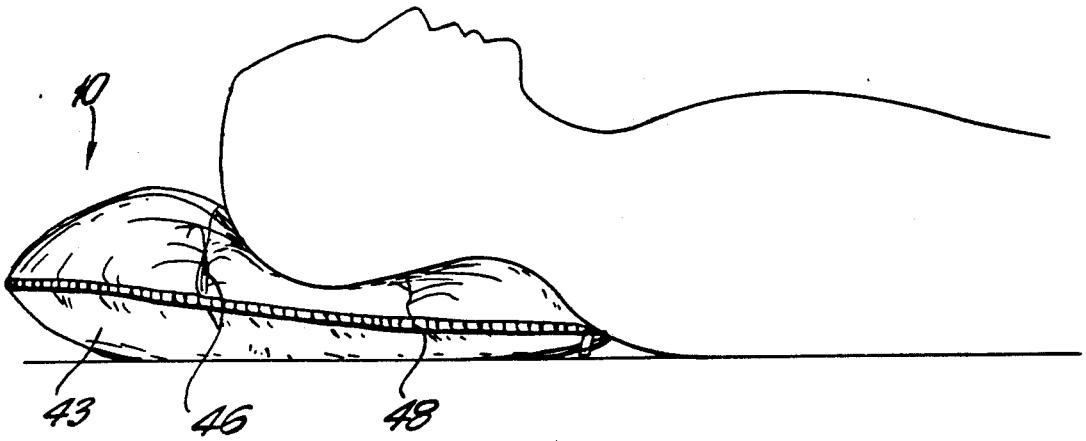
FIG. 2 is a side elevational view of a user of the pillow of FIG. 1 in a supine position whereby the neck (cervical area) and head of the user rest on the pillow.

The user places the pillow 10 on the bed or other surface with the quilted portion 46 facing up, as in FIGS. 1 and 2. The head of the user always rests on the quilted portion 46.

The user then determines which of the two cervical rolls 25 or 26 offers the most comfort or support. Cervical rolls 25 and 26 address different cervical and side-of-the-neck contouring.

To determine which roll is appropriate, the user lies in the supine position with the neck first resting on one of the rolls 25 or 26 and the head in depression 27. If that positioning is not comfortable, the user rotates the pillow 180 degrees and rests the neck on the other cervical roll and the head in the depression 27.

Some persons prefer the higher or more pronounced neck or cervical support of the major cervical roll 25 while others prefer the lower and less pronounced neck support of the minor cervical roll 26. The differences between the hard foam of minor cervical support 26 and the medium foam of major cervical support 25 relate to anatomical shape (depth, distance of length, etc.) of the cervical curve and also the comfort preferences of certain users. Also, the user can choose which cervical roll to use based on the different convexities (first convex portion **25*b* and second convex portion 26*b*) of roll 25 and roll 26**.

Appropriate word or color-coded labelling may be attached to the pillow 10 to advise the user which orientation of the pillow 10 provides higher neck support from roll 25 and which provides lower neck support from roll 26.

After determining which cervical roll (25 or 26) offers the best support or comfort, the user must then determine which, if any, of inserts 31, 32 or 33 are also needed.

For those persons who like to sleep lying on their back and want the maximum cervical and head support, pillow 10 can also be used to increase the height of the sides while minimally increasing the height of the middle portion of the pillow, as opposed to increasing uniformly the pillow height. In this regard, the v-shaped insert 33 is placed in pockets 44 and 45 such that the base **39*a* of the "v" is aligned with the major cervical roll 25 when the pillow 10 is closed up. In this configuration, the head of the user is confined in the more restricted portion of depression 38 and the major roll 25** offers maximum cervical support.

For lesser cervical support in the supine position, the user inserts v-shaped insert 33 into pockets 44 and 45 such that the minor cervical roll 26 is aligned with the base **39*a* of the "v" in insert 33. This gives less cervical support than the configuration set forth in the preceeding paragraph, but still offers that "tight" control of the head in depression 38**.

For lying on the side, the user should align the desired cervical roll (25 or 26) with the open end **39*b* of the v-shaped insert 33. This provides a greater area in depression 38 in the center of the pillow 10** for the user to rest the side of his face while lying in the side position.

Side portions 23 and 24 of foam core 20 may also be used for side-lying. Side portions 23 and 24 address side of neck and shoulder contouring by virtue of the height of the pillow 10 and by virtue of the resiliency of the polyester filament material 47 and the foam of side portions 23 and 24.

For those persons who lie on both their back and their side when sleeping, it is best to insert insert 33 such that the desired roll (25 or 26) is aligned with the open end **39*b*** of the "v". This allows for a wider area for the head and neck when the person rolls from his back to his side and vice versa.

V-shaped insert 33 may also be used in one of two secondary orientations, whereby the insert 33 is "turned over" such that the depression 38 faces downwardly, as opposed to the upward position shown in FIG. 6. When facing downwardly, the insert 33 may be orientated in one of two ways, similar to the two orientations shown in FIGS. 7 and 8. The downward secondary orientations of insert 33 moderate the height transitions the user encounters between the sides 35 and 36 and the depression 38.

Height inserts 31 and 32, which are ½" and ¾" in height, respectively, in the preferred embodiment, are added into pockets 44 and 45 beneath v-shaped insert 33 as needed. One, both or neither of the height inserts 31 and 32 may be added to the pillow 10, depending upon the comfort and height requirements of the user. The height inserts 31 and 32 allow for height adjustment of the pillow 10 from the bed surface in order to account for different size cervical concavities of users and also varying shoulder heights and side-of-the-neck concavities.

The pillow may also be used without the v-shaped insert 33 and with one or both of the height inserts 31 or 32.

Users with broad shoulders, when sleeping on their side, may wish to lay the side of their face on the side pieces 35 and 36 of the v-shaped insert 33. Although this negates the defined supporting effect of roll 25 or 26, it allows the broad-shouldered person to add desired height to the pillow 10 without the necessity of adding insert 31 or insert 32. The resiliency of the constituent materials of the pillow 10 without inserts 31 and 32 provides gentle support by comprehensively conforming to the shape of the side of the face, the jaw, the neck and the shoulders of the user.

The pillow 10 is always used so that the head of the user rests on the quilted portion 46 of the pillow 10. The polyester filament material 47 is always directly under the user and serves to soften the feel of the pillow to the user and also moderates any feeling of "climbing" up from depressions 27 and 38 to the side portions 23, 24 or side pieces 35, 36, respectively.

When lying on the side with the side of the head on the pillow 10, roll 25 or 26 (depending on which way the pillow is aligned) helps to promote horizontal alignment of the spine and head. This is important because maintaining a neutral, straight-line horizontal position is essential for preventing head and neck rotation. Such rotation can lead to stiffness and pain by upsetting the natural balance occurring between musculo-skeletal and neurological structures composing the neck, head and thoracic region.

When the user is in the supine position, roll 25 or 26 insures that there is cervical concavity. This is important because maintenance of the natural lordotic curve of the cervical area of the spine will help to align the contiguous head, neck and thoracic sections of the spine in correct anatomical position. This alignment deters over-extension (hyperextension) or undue flexion from occurring thereby preventing additional pain or further deterioration of the cervical spine or surrounding anatomical structures.

The v-shaped insert 33 can be inserted in pockets 44 and 45 in one of two primary orientations. One orientation is shown in FIG. 7; the second is shown in FIG. 8. The user can place his head either in the wider or narrower portion of depression 38, depending on the size of the head, the amount of side support for the head desired by the user, etc. The user matches the desired portion of depression 38 with the desired cervical roll 25 or 26 by means of the orientation of v-shaped insert 33.

The side foam portions 23 and 24 of foam core 20 act in some manner to cradle laterally or support the head. Also, use of the narrower portion of depression 38 gives the user the impression of greater support surrounding the head; conversely, use of the wider portion of depression 38 gives the user the impression of less support surrounding the head.

The pillow 10 of the present invention is comfortable in the supine (lying on the back) and side-lying positions. The pillow 10 allows for a gradual transition between supine-lying and side-lying without appreciably changing the natural spinal curve and body position that a person maintains while in an upright position.

The pillow 10 of the present invention can also serve as a neck and head support while the user is sitting up in a chair or bed. The pillow may also be used to support limbs while a user is lying down or sitting. For example, the pillow 10 may be used as an arm support for post-mastectomy patients who have special postural and comfort requirements during recuperation.

The possible pillow height variations, the different I.F.D. ratings of the various foam pieces and the various shapes incorporated in the pillow 10 of the present invention accommodate the significant differences in specific needs of users as determined by physical factors and psychological preferences. The pillow 10 of the present invention also moderates certain negative effects due to the constant motion and maneuvering of the head and neck during the ordinary sleep cycle.

The ability to modify the configuration of the pillow of the present invention permits a post-operative patient to gain maximum advantage from the pillow depending on the stage of recovery.

It is readily understood that the pillow of the present invention may be used in any number of configurations depending upon the arrangement of its component parts. The description of the manner of use given above is for exemplary purposes only.

It is also understood that foams with different I.F.D. ratings than the foams specified in the preferred embodiment may be used in the pillow of the present invention.

Our invention is defined by the following claims.

We claim:

1. A cervical and head support pillow comprising:

an outer covering having a top half and a bottom half;

receiving means on a first side of the bottom half of the outer covering;

a v-shaped foam insert located in the receiving means, the v-shaped foam insert having first and second angled side portions defining a depression in the v-shaped foam insert, the depression having the approximate shape of a "v" wherein the first and second angled side portions converge toward one another toward a first edge of the insert and diverge from one another at a second edge of the insert; and means for securing the top half of the outer covering to the bottom half of the outer covering.

2. The pillow of claim 1 also comprising a second height adjustment insert means located in the receiving means for adjusting the height of the pillow when the top half of the outer covering is secured to the bottom half.

3. The pillow of claim 2 also comprising a second height insert means located in the receiving means, the height of the second height insert means being less than the height of the first height insert means.

4. The pillow of claim 3 wherein the first height insert means and the second height insert means each comprise a rectangular piece of soft foam.

5. The pillow of claim 1 wherein the angled side portions of the v-shaped insert comprise a first angled medium foam side piece and a second angled medium foam side piece, the v-shaped insert further comprising:

a rectangular medium foam base piece;

means for securing the first and second angled medium foam side pieces to the rectangular medium foam base piece; and a form-fitting cloth cover fitted over the combination of the base piece and the first and second angled side pieces.

6. A cervical and head support pillow comprising:

an outer covering having a top half and a bottom half;

receiving means on a first side of the top half of the outer covering;

a foam core located in the receiving means on the first side of the top half of the outer covering, the foam core comprising:

side portions defining a first depression in the foam core intermediate the side portions;

first cervical support means having a first convex portion, the first cervical support means being located at a first edge of the foam core intermediate the side portions;

second cervical support means having a second portion, the second cervical support means being located at a second edge of the foam core opposite the first edge of the foam core and intermediate the side portions, wherein the second cervical support means is made of a harder material than the first cervical support means;

receiving means on a first side of the bottom half of the outer covering;

a v-shaped foam insert located in the receiving means on the first side of the bottom half of the outer covering, the v-shaped foam insert having angled side portions defining a second depression in the v-shaped foam insert, the second depression having the approximate shape of a "v" wherein the edges of the angled side portions converge toward one another toward the base of the "v" in the second depression and diverge from one another away from the base of the "v" in the second depression; and means for securing the top half of the outer covering to the bottom half of the outer covering.

7. The pillow of claim 6 wherein the degree of convexity of the second convex portion of the second cervical support means is less than the degree of convexity of the first convex portion of the first cervical support means.

8. The pillow of claim 6 wherein the foam core is constructed of soft foam except for the first and second cervical support means which are constructed of hard foam and medium foam, respectively.

9. The pillow of claim 6 wherein the side portions of the foam core comprise a first rectangular side piece and a second rectangular side piece, the foam core further comprising a rectangular base foam portion;

means for securing the first side piece to the top of the base foam portion;

means for securing the second side piece to the top of the base foam portion;

means for securing the first cervical support means to the top of the base foam portion intermediate the first and second side piece portions; and means for securing the second cervical support means to the top of the base foam portion intermediate the first and second side pieces whereby the first and second side pieces and the first and second cervical support means surround and define the first depression in the foam core.

10. The pillow of claim 6 further comprising;

a plurality of receiving means on a second side of the top half of the outer covering;

quilting means separating individual receiving means on the second side of the top half; and filament material located in each of the receiving means on the second side of the top half.

11. The pillow of claim 6 wherein the receiving means on the first side of the top half of the outer covering comprises a first pocket sewn in the first side of the top half of the outer covering.

12. The pillow of claim 6 also comprising first height adjustment insert means located in the receiving means on the first side of the bottom half of the outer covering for adjusting the height of the pillow when the top half of the outer covering is secured to the bottom half.

13. The pillow of claim 12 also comprising a second height insert means located in the receiving means on the first side of the bottom half of the outer covering, the height of the second height insert means being less than the height of the first height insert means.

14. The pillow of claim 13 wherein the first height insert means and the second height insert means each comprise a rectangular piece of soft foam.

15. The pillow of claim 6 wherein the angled side portions of the v-shaped insert comprise a first angled medium foam side piece and a second angled medium foam side piece, the v-shaped insert further comprising:

a rectangular medium foam base piece;

means for securing the first and second angled medium foam side pieces to the rectangular medium foam base piece; and a form-fitting cloth cover fitted over the combination of the base piece and the first and second angled side pieces.

* * * * *